US005226089A

United States Patent [19]

Yoon et al.

[11] Patent Number: 5,226,089

[45] Date of Patent: Jul. 6, 1993

[54] CIRCUIT AND METHOD FOR COMPENSATING LOW FREQUENCY BAND FOR USE IN A SPEAKER

[75] Inventors: Sang-Lak Yoon, Suwon, Rep. of Korea; Naraji Sakamoto, Osaka, Japan

[73] Assignee: Samsung Electronics Co., Ltd., Rep. of Korea

[21] Appl. No.: 677,471

[22] Filed: Mar. 29, 1991

[30] Foreign Application Priority Data

Apr. 16, 1990 [KR] Rep. of Korea ..... 1990-5247

[51] Int. Cl.[5] ..... H04R 3/00

[52] U.S. Cl. ..... 381/96; 381/59

[58] Field of Search ..... 381/96, 59

[56] References Cited

U.S. PATENT DOCUMENTS

| | | | |
|---|---|---|---|
| 5,009,281 | 4/1991 | Yokoyama | 381/96 |
| 5,031,221 | 7/1991 | Yokoyama | 381/96 |

FOREIGN PATENT DOCUMENTS

| | | | |
|---|---|---|---|
| 366109 | 5/1990 | European Pat. Off. | 381/96 |
| 2269267 | 11/1975 | France | 381/96 |
| 113521 | 10/1978 | Japan | 381/96 |
| 57-188198 | 11/1982 | Japan | 381/96 |

*Primary Examiner*—Forester W. Isen

[57] ABSTRACT

A circuit and method are disclosed for improving low frequency characteristics in a speaker by detecting the motion of a vibration system of the speaker to be fed back to the vibration system. The circuit detects the motion signal by bridge-balancing the input and output signals of the speaker to detect a voltage difference therebetween. Low frequency reproduction characteristics of the speaker are compensated by reducing lowest resonance frequency characteristics of the speaker and at the same time compensating intrinsic impedance characteristics thereof. The audio signal being reproduced is detected by bridge-balancing the output of the speaker, and dynamic impedance caused by the vibration system is detected by calculating the difference between the detected audio signal and an audio signal applied to the speaker. The motion of the vibration system is converted into acceleration motion at a lowest resonance frequency of the speaker and the motion of the vibration system is converted into a speed value to change resonance sharpness of the speaker. Thereafter, signal adding is performed such that a difference of converted acceleration motion is negatively fed back while a converted velocity value is positively fed back, and the feedback signals are added with the audio signal applied to the speaker so that low frequency reproduction characteristics of the speaker can be compensated.

6 Claims, 6 Drawing Sheets

- - - - - - : PRE-CONVERSION
——— : PRO-CONVERSION

CIRCUIT AND METHOD FOR COMPENSATING LOW FREQUENCY BAND FOR USE IN A SPEAKER

FIELD OF THE INVENTION

The present invention relates to a speaker operating system, and, more particularly, to a circuit and method for controlling a vibration system in a speaker to improve low frequency characteristics thereof.

BACKGROUND OF THE INVENTION

In general, the frequency from 20 Hz to 20 KHz is a commonly employed frequency range utilized in an audio and video signal processing system that performs digital signal processing of acoustic or sound signals. A digital signal processing technique has a tendency to have wider dynamic range and characteristics, compared with an analog signal processing technique, therefore an original signal input can be more faithfully processed and amplified at a signal input section, a signal processing section and a power amplification section of the digital audio and video signal processing system. Unfortunately, however, sound reproduction of a speaker needs improvement.

Today's speaker system include a three-way type employing a tweeter for high-frequency sound reproduction, a squawker for medium-frequency sound reproduction and a woofer for low-frequency sound reproduction, and a two-way type employing the tweeter and the woofer. In order to improve low-frequency characteristics of the woofer, lowest resonance frequency should be set to the low frequency, and in such a case the diameter of a vibration plate must be large to improve the low-frequency characteristics. However, when the diameter of the vibration plate is large, volume of the speaker system becomes large as well, limiting installation environment. For this reason, small speaker systems will have a drawback that the sound signal of the low frequency cannot be faithfully reproduced due to the small volume of the speaker even in the case of receiving a high quality audio signal. In addition, the overall reproduction characteristics of the speaker cannot be improved even though the above method is employed to improve reproduction characteristics of the low frequency component of an audio signal by changing the diameter of the vibration plate of the speaker system.

SUMMARY OF THE INVENTION

It is therefore an object of the present invention to provide a circuit and method for improving low frequency characteristics in a speaker by detecting motion of a vibration system of the speaker for feedback to the vibration system.

It is another object of the present invention to provide a circuit and method for electrically detecting motion of the vibration system by bridge-balancing input and output signals of the speaker to detect a difference between the two signals.

According to an aspect of the present invention, low frequency reproduction characteristics of a speaker are compensated by reducing lowest resonance frequency characteristics of the speaker and simultaneously compensating intrinsic impedance characteristics thereof. An audio signal being reproduced is detected by bridge-balancing an output of the speaker, dynamic impedance caused by the vibration system is detected by determining the difference between the detected audio signal and an audio signal applied to the speaker. Then, motion of the vibration system is converted into acceleration motion at a lowest resonance frequency of the speaker and the motion of the vibration system is converted into a speed value to change resonance sharpness of the speaker. Thereafter, a signal mixing is performed such that the difference of the converted acceleration motion is negatively fed back while the converted velocity value is positively fed back, and those signals are mixed again with the audio signal applied to the speaker so that low frequency reproduction characteristics of the speaker can be compensated.

BRIEF DESCRIPTION OF THE ATTACHED DRAWINGS

For a better understanding of the invention and to show how the same may be carried into effect, reference will now be made, by way of example, to the accompanying drawings, in which:

FIGS. 5A to 5J are waveforms of each part the circuit shown in FIG. 4, in which FIGS. 5A to 5D illustrate characteristics of frequency versus dynamic impedance and FIGS. 5E to 5J illustrate waveform diagrams of characteristics of frequency versus detected voltage.

DETAILED DESCRIPTION OF THE PREFERRED EMBODIMENT

For the convenience of explaining, an embodiment in which a lowest resonance frequency $f_o$ is shifted to a low frequency band and at the same time a resonance sharpness $Q_o$ is compensated, to improve the low frequency characteristics of a speaker, as explained hereinbelow. To compensate characteristics of the speaker, it is necessary to control motion of a vibration system by detecting the motion of the vibration system and then feeding back the detected motion within vibration system. The vibration system of the speaker has a plurality of resistor components, such as a voice coil, cone paper and duct, and the reproduction efficiency of a speaker depends greatly on the vibration system. Therefore, when operating the speaker, a velocity signal of dynamic impedance of the vibration system is converted into an acceleration signal to shift the lowest resonance frequency $f_o$ to the low frequency band and a velocity conversion procedure is performed to improve the efficiency of the speaker after the dynamic impedance is detected from the motion of the vibration system. And then, signal adding is performed by negatively feeding back an acceleration converted value according to the motion of the vibration system of the speaker and positively feeding back the velocity converted value, and then the added signal is added with an audio signal applied to the speaker. Therefore, the speaker can reproduce an audio signal of which motion of the vibration system of the speaker is compensated, realizing fuller reproduction of the audio signal.

Figure 2A:
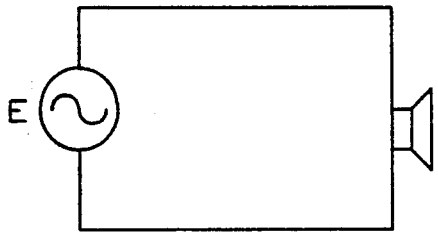
FIG. 2A is an equivalent circuit diagram of an infinite baffle.

Referring now to FIGS. 2A to 2E to take a detailed view of characteristics of the speaker, FIG. 2A is a diagram of an equivalent circuit in case where a cone speaker is adopted to infinite baffle, and herein a regulated AC voltage E is applied to the speaker, internal impedance of which at this moment is "0". Here, let $R_E$ in ohms represent DC resistance of the voice coil, $L_E$ in henries represent inductance of the voice coil and $Z_E$ in ohms represent impedance of the voice coil, then $$Z_E = R_E + j\omega L_E 2 \quad (1)$$

Herein, terminal voltage E of the voice coil is represented by adding the voltage drop caused by the $Z_E$ to the electromotive force generated by the motion of the vibration system of the speaker, and overall impedance $Z_{SP}$ in ohms of the speaker can be expressed in the expression (2) as follows:

$$Z_{SP} = \frac{E}{I} = Z_E + \frac{YV}{I} = Z_E + \frac{Y^2 V}{F} = Z_W + \frac{Y^2}{ZM} \quad (2)$$

Wherein, E is a voltage applied to the speaker, I is electric current, Y is inverse coefficient, V is velocity in m/sec of the voice coil, F is electromotive force, and $Z_M$ is impedance of the mechanical system. In addition, let B in wb/m$^2$ represent magnetic flux density of a magnetic path air gap and l in meters represent a length of the voice coil, then expression (3) can be derived as follows:

$$Y = B \cdot l$$
$$E = Y \cdot V$$
$$I = \frac{Y}{F}$$
$$Z_M = \frac{F}{V} \quad (3)$$

Here, the second term on the right-hand side of the expression (2) is the impedance generated by the vibration system. Let dynamic impedance thereof be represented by $Z_{EM}$, thus $$Z_{EM} = \frac{Y^2}{ZM} \quad (4)$$

Figure 2B:
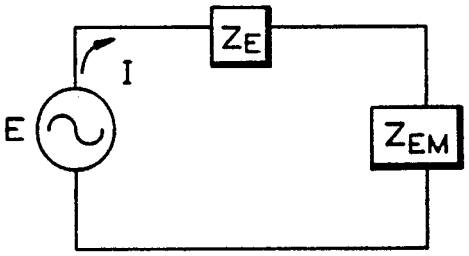
FIG. 2B is an equivalent circuit diagram of the speaker.

An equivalent circuit viewed a terminal of the voice coil is shown in FIG. 2B wherein impedance $Z_E$ of the speaker and dynamic impedance $Z_{EM}$ are coupled in series.

Figure 2C:
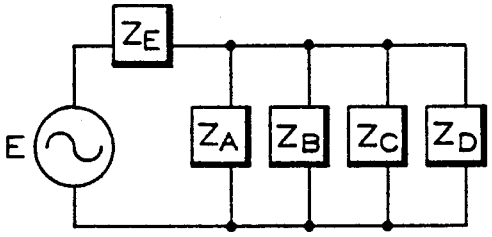
FIG. 2C is an equivalent circuit diagram for mechanical impedance of the circuit shown in FIG. 2B.

FIG. 2C is a diagram wherein the equivalent circuit of the speaker shown in FIG. 2B is illustrated as an equivalent circuit of the mechanical system of the entire vibration system. Here, let mass of the voice coil be $M_{M1}$ in kg, mass of the speaker cone be $M_{M2}$ in kg, radiation mass be $M_{MA}$ in kg, radiation resistance be $R_{MA}$ in ohms, mechanical resistance of the entire vibration system be $R_{MS}$ in ohms, and stiffness of the entire vibration system be $S_m$(N/m), then expressions (5) to (8) can be established and each component is coupled in parallel.

$$Z_A = \frac{Y^2}{R_{MS}} \quad (5)$$

$$Z_B = \frac{Y^2}{j\omega(M_{M1} + M_{M2} + 2M_{MA})} \quad (6)$$

$$Z_C = \frac{j\omega Y^2}{S_M} \quad (7)$$

$$Z_D = \frac{Y^2}{2R_{MA}} \quad (8)$$

Figure 2D:
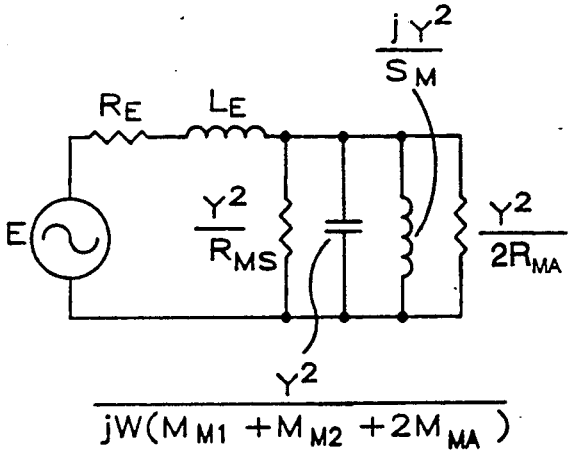
FIG. 2D is another equivalent circuit diagram of the circuit as shown in FIG. 2C.

Wherein, the diagram of FIG. 2C is shown as an electrical equivalent circuit in FIG. 2D.

Figure 2E:
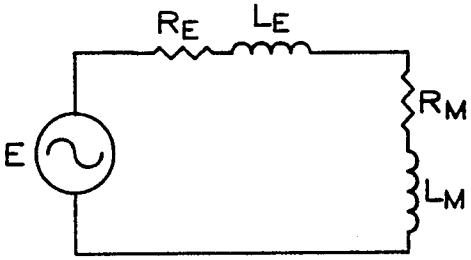
FIG. 2E is an impedance equivalent circuit diagram of the circuit as shown in FIG. 2D.

In FIG. 2D, the dynamic impedance $Z_{EM}$ is illustrated in a serial circuit of $R_E$, $L_E$, $R_M$, and $L_M$, and the $L_E$ value of the voice coil is so small that it can be ignored in a low frequency band. The equivalent circuit of the dynamic impedance of FIG. 2D can be simplified as illustrated in FIG. 2E as a single impedance. Accordingly, impedance $Z_{SP}$, of the entire speaker can be expressed as $R_E + R_M + J\omega L_M$. In addition, dynamic impedance $Z_{EM}$ of the vibration system of the speaker can be expressed as $R_M + j\omega L_M$. Therefore, when reproducing an audio signal through a speaker, the speaker can have desired sound reproduction characteristics of the low frequency band by detecting the dynamic impedance $Z_{EM}$ generated by the vibration system of the speaker and then controlling the motion of the vibration system by feeding back the detected dynamic impedance. In order to improve low frequency band characteristics of the speaker by utilizing MFB (Motion Feed-Back) as described above, the characteristics of lowest resonance frequency $f_o$ are improved by converting a velocity signal of the dynamic impedance $Z_{EM}$ to an acceleration signal which is then negatively fed back, and resonance sharpness $Q_o$ is improved and positively fed back to improve efficiency of the speaker by converting the velocity signal of the dynamic impedance $Z_{EM}$.

Figure 1:
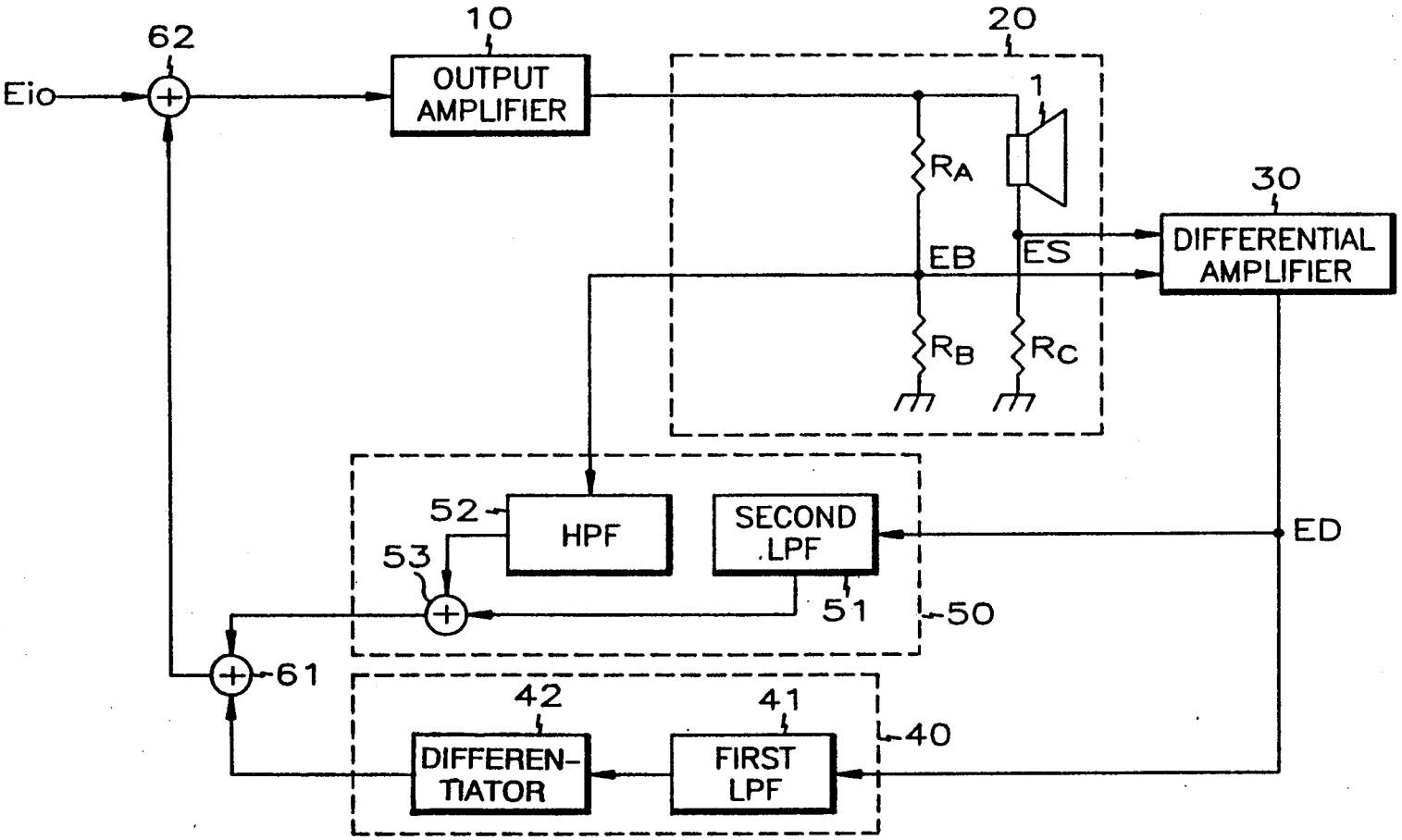
FIG. 1 is a block diagram of a reproduction system for compensating motion of a vibration system of the speaker according to the present invention.
Figure 3:
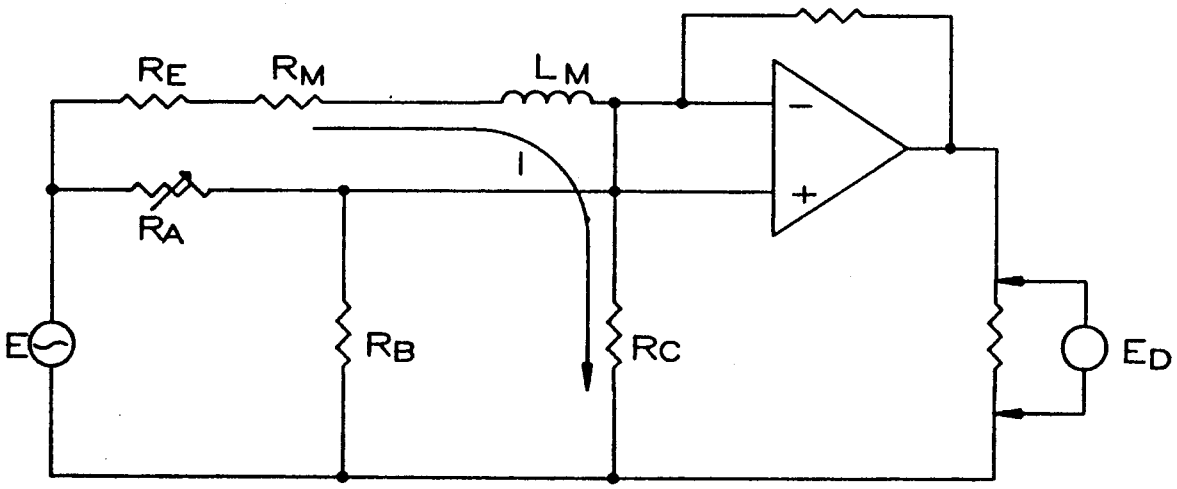
FIG. 3 is a schematic diagram of a circuit for detecting motion of a vibration system of the speaker according to the present invention.
Figure 4:
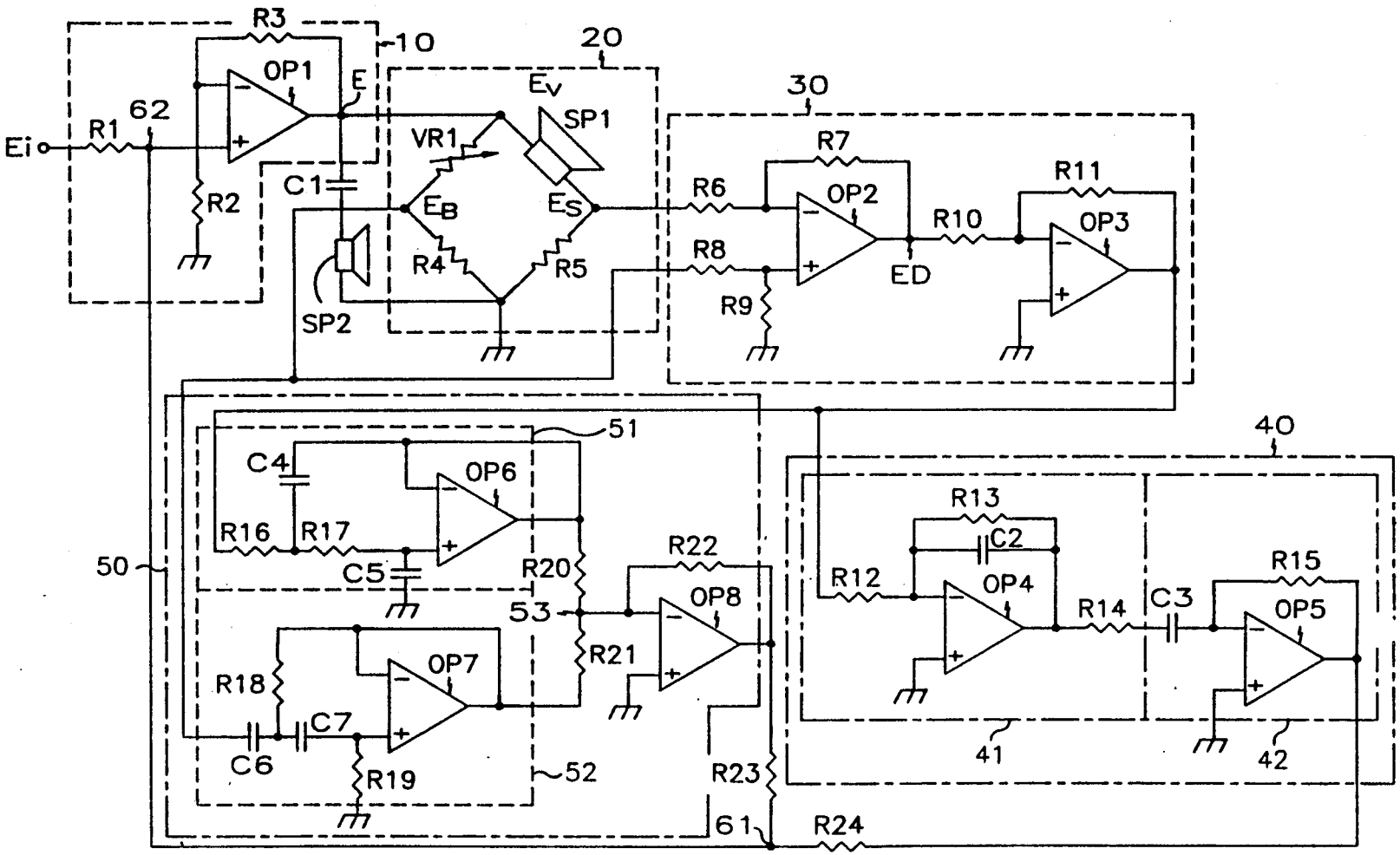
FIG. 4 is a detailed circuit diagram for the circuit of FIG. 1.

Referring now to FIGS. 1, 3 and 4, a closer look will be given on the process wherein the low frequency band characteristics of the speaker are improved by detecting dynamic impedance $Z_{EM}$ of the speaker and feeding back the detected dynamic impedance $Z_{EM}$ to the speaker.

In the bridge circuit 20, audio signals provided from an output amplifier 10 are produced as a first signal $E_B$ by voltage division caused by resistors $R_A$ and $R_B$, and as a second signal $E_S$ by voltage division caused by a speaker 1 and a resistor $R_C$. Herein, the speaker 1 reproduces the inputted audio signal as audible sound, and in the speaker 1 there exists intrinsic input impedance of the speaker itself and dynamic impedance $Z_{EM}$, which is produced by the motion of the vibration system. In the bridge circuit 20, resistance value of a resistor R4 is set to have a same value as intrinsic impedance value of the speaker 1, and the resistors $R_B$ and $R_C$ are set to have the same impedance value, in order to detect the dynamic impedance of the speaker 1. Accordingly, in the bridge circuit 20, when resistance ratio of $R_A$:$R_B$ =(intrinsic input resistance R5 of the speaker):RC, the first signal $E_B$ as an intrinsic input audio signal becomes a reference signal to detect the dynamic impedance $Z_{EM}$, and the second signal $E_S$ as an audio signal which is reproduced through the speaker 1, becomes a signal having the dynamic impedance. When the second signal $E_S$ is subtracted from the first signal $E_B$ through a differential amplifier 30, a signal difference of the two signals is generated and the signal difference becomes a voltage $E_D$ proportional to the dynamic impedance $Z_{EM}$ as illustrated in FIG. 3. That is, when bridge balance is taken using a frequency generated by the intrinsic input resistance component $R_E$ of the speaker output of the differential amplifier 30 becomes a voltage proportional to the dynamic impedance $Z_{EM}$, which is generated by the motion of the vibration system including the voice coil at the low frequency band. Here, output of the differential amplifier 30 becomes $E_D=I(R_M+j\omega L_M)$. The detected voltage $E_D$ can be expressed as in expression (9);

$$E_D = \frac{\frac{E}{B1}}{\left\{1 + jQ_o\left(\frac{f}{f_o} - \frac{f_o}{f}\right)\right\}\left(1 + \frac{R_E R_{MS}}{B1}\right)} \tag{9}$$

Where B is the gain of the differentiator 42 and first low pass filter. In expression (9), when $$R_{MS} << \frac{(B1)^2}{R_E}$$

the detected voltage $E_D$ can be expressed as in expression (10);

$$E_D = \frac{\frac{E}{B1}}{1 + jQ_o\left(\frac{f}{f_o} - \frac{f_o}{f}\right)} \tag{10}$$

In expression (10), the ratio which is established between the detected voltage $E_D$ and a voltage obtained according to the motion of the vibration system, becomes a ratio of an inverse coefficient (Y=B.l) of the speaker 1 to a detection circuit, and an expression $E_D/E$ becomes feed-back voltage gain of a medium and low frequency band sound reproduction speaker.

Next, MFB (motion feed-back) processing procedure and characteristics of the detected voltage will be described. Input voltage of the output amplifier 10, lowest resonance frequency, and selectivity resonance sharpness Q are referred to as Ei, $f_o$ and resonance sharpness $Q_o$, respectively, and $f_o$ and $Q_o$ after feed-back are referred to as $f_o'$ and $Q_o'$, respectively. In addition, gain of the output amplifier 10, and gain of the feed-back circuit are respectively referred to as A and B.

First, the acceleration converting process is performed at an acceleration converter 40, when the dynamic impedance $Z_{EM}$ is received through the differential amplifier 30. To convert the velocity signal into the acceleration signal, a feedback circuit having differentiation characteristics is added to the acceleration converter.

A voltage having dynamic phase (i.e., differential voltage) proportionate to acceleration is generated by differentiating the velocity signal, which is detected as dynamic impedance $Z_{EM}$, of the motion of the vibration system of the speaker 1. That is, in the acceleration converter 40, the velocity signal, which is detected at the differential amplifier 30, according to the dynamic impedance $Z_{EM}$ of the speaker 1 is filtered through a first low-pass filter 41 to the low frequency band, for which the MFB is to be performed, and then the low-pass-filtered velocity signal is differentiated to be converted to the acceleration signal through differentiator 42. Here, in the case of the negative feed-back of acceleration signal, let loop gain be $A_{11}$, then expression (11) is established, and overall gain $A_0$ is expressed as shown in expression (12).

$$A_{11} = \frac{\frac{j\omega AB}{B1}}{1 + jQ_o\left(\frac{f}{f_o'} - \frac{f_o'}{f}\right)} \tag{11}$$

$$A_0 = \frac{A}{1 + A_{11}} \tag{12}$$

By deriving expressions (11) and (12), the acceleration signal m/sec is output from outputted through the differentiator 42 as in expression (13):

$$V_1 = \frac{\frac{E_i A_o}{B1}}{1 + jQ_o\left(\frac{f}{f_o'} - \frac{f_o'}{f}\right)} \tag{13}$$

If $D_1$ represents a difference value of feed-back quantity of acceleration generated according to expression (13), then expression (14) as below is established, and resonance sharpness $Q_o'$ and lowest resonance frequency $f_o'$ after feed-back are expressed as in expressions (15) and (15):

$$D_1 = 1 + \frac{\frac{AB}{B1}}{Q_o} \tag{14}$$

$$Q_o' = Q_o\sqrt{D_1} \tag{15}$$

$$f_o' = \frac{f_o}{\sqrt{D_1}} \tag{16}$$

Accordingly, the lowest resonance frequency $f_o$ is lowered to $$\frac{1}{\sqrt{D}}$$

for output of the output amplifier 10 which is applied to the speaker 1 by the acceleration signal that is fed back through the acceleration converter 40, resonance sharpness $Q_o$ is $\sqrt{D_1}$ times increased and the sound pressure level is lowered to $20\log D_1$ decibels. Therefore, the lowest resonance frequency $f_o$ is shifted to the lower frequency band by $$\frac{1}{\sqrt{D}}$$

by converting the dynamic impedance signal generated by the motion of the vibration system of the speaker 1, so that the speaker 1 into the acceleration signal can fully reproduce low-frequencies of the audio signal.

After going through the acceleration converter 40, the resonance sharpness $Q_o$ characteristics of the acceleration signal increases $D_1$ times to improve efficiency of a speaker when reproducing a sound. Therefore, the characteristics of resonance sharpness $Q_o$, which is increased $\sqrt{D_1}$ times at the acceleration converter 40, is compensated in a velocity converter 50. The detecting voltage outputted through the differential amplifier 30 is a voltage proportionate to velocity according to the motion of the vibration system of the speaker 1. The velocity converter 50 performs velocity conversion to appropriately adjust the resonance sharpness $Q_o$ characteristics by using a second low-pass filter 51. Here, cut-off frequency of the second low-pass filter 51 is set to a value that includes a maximum low frequency which is within a desired low frequency range but it is still unable to oscillate. In addition, the first signal $E_B$, which is a reference signal, is high-pass-filtered by the high-pass filter 52, so that no influence is given to high frequency band audio signal during the process of velocity conversion.

In a closer look into the process of the velocity conversion, let the loop gain be $A_{11}$ in the case of positive feed back of the velocity. The loop gain $A_{11}$ can be expressed as expression (17), and the overall gain $A_0$ can be expressed as expression (18):

$$A_{11} = \frac{\frac{AB}{Bl}}{1 + jQ_o\left(\frac{f}{f_o} - \frac{f_o}{f}\right)} \quad (17)$$

$$A_0 = \frac{A}{1 - A_{11}} \quad (18)$$

Here, the value of Velocity $V_2$ in m/sec is output outputted from the second low-pass filter 51 and established by expressions (17) and (18) as in expression (19) below:

$$V_2 = \frac{\frac{E_i A}{Bl}}{\frac{AB}{Bl} + \left\{1 + jQ_o\left(\frac{f}{f_o} - \frac{f_o}{f}\right)\right\}} \quad (19)$$

Therefore, the difference value $D_2$ of the velocity feed-back quantity generated in accordance with expression (19) can be represented by expression (20), and the resonance sharpness $Q_o'$ and the lowest resonance frequency $f_o'$ after the feed-back, can be expressed as expressions (21) and (22).

$$D_2 = \frac{Q_o}{1 - \frac{AB}{Bl}} \quad (20)$$

$$Q_o' = \frac{Q_o}{D_2} \quad (21)$$

$$f_o' = f_o \quad (22)$$

Accordingly, in the output of the velocity converter 50 the resonance frequency $f_o$ and the sound pressure level remain unchanged and resonance sharpness $Q_o$ is decreased to $$\frac{1}{D_2}.$$

Therefore, the resonance sharpness $Q_o$ at the lowest resonance frequency $f_o'$ will be decreased by the second low pass filter 51. That is, the velocity conversion process compensates the resonance sharpness $Q_o$ at the lowest resonance frequency $f_o'$, converted in the acceleration conversion process. In addition, the high-pass filter 52, into which the first signal $E_B$ is supplied, high-pass-filters the high frequency band audio signal so the high frequency band audio signal were not to be affected by the velocity and acceleration MFB operations. In this case, it is ideal for the cut-off frequencies of both the second low pass filter 51 and the high pass filter 52 to be the same, or the cut-off frequency of the high pass filter 52 should be set no greater than 15%, in frequency, of that of the second low pass filer 51. Outputs of the second low-pass filter 51 and the high-pass filter 52 are first added in adder 53. The output of adder 53 is a compensated signal such that the resonance sharpness $Q_o$ at the lowest resonance frequency $f_o$ is compensated during feed-back and no influence is made on the high frequency band audio signal.

The output of the adder 53 and the lowest resonance frequency $f_o$ of which the low frequency band is shifted at the differentiator 42 are added in adder 61, and the output of adder 61 is such a state that the lowest resonance frequency $f_o$ is compensated for the low frequency band, at the same time resonance sharpness $Q_o$ is appropriately compensated and high frequency band audio signal is stabilized so that no influence can be made on the high frequency band of the audio signal that is provided at the time of feed-back operation. The output of added 61 is then added with the audio signal that is applied to the speaker 1 at adder 62. Therefore, the lowest resonance frequency $f_o$ of the audio signal is compensated for the low frequency band and at the same time the resonance sharpness $Q_o$ is appropriately compensated before being applied to the output amplifier 10, and no influence is made on the high frequency band audio signal.

The output amplifier 10 amplifies the audio signal from adder 62 such that the amplified audio signal is appropriate to the reproduction characteristics of the speaker 1. Accordingly, the audio signal is not influenced at its high frequency band. Since, however, the dynamic impedance $Z_{EM}$ at the low frequency band was compensated according to the motion of the vibration system of the speaker 1, the speaker can fully reproduce the low frequency band component of the audio signal according to the audio signal so that the reproduced low frequency band sound will be closer to the original sound.

FIG. 4 is an embodiment of the block diagram of FIG. 1 according to the present invention, showing composition of a two-way type speaker system that uses one woofer and one tweeter which corresponds to the speaker 1 of FIG. 1.

In addition, FIG. 5 shows operating waveforms of the circuit shown in FIG. 4, in which FIGS. 5A to 5D are timing diagrams showing characteristics of frequency versus dynamic impedance and FIGS. 5E to 5J are timing diagrams showing characteristics of the frequency versus the detected voltage.

Figure 5A:
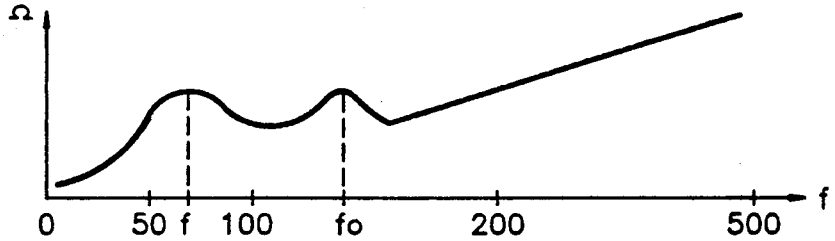

First, it is assumed that impedance of the woofer SP1 has characteristics as shown in FIG. 5A when no MFB operation is performed, in which $f_o$ is the lowest resonance frequency of the woofer SP1 and the f is the resonance frequency generated by a duct.

Figure 5B:
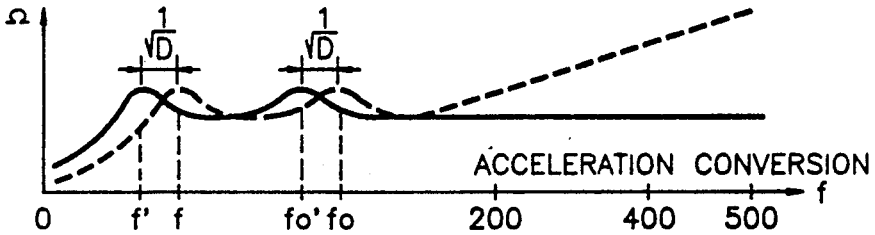
Figure 5C:
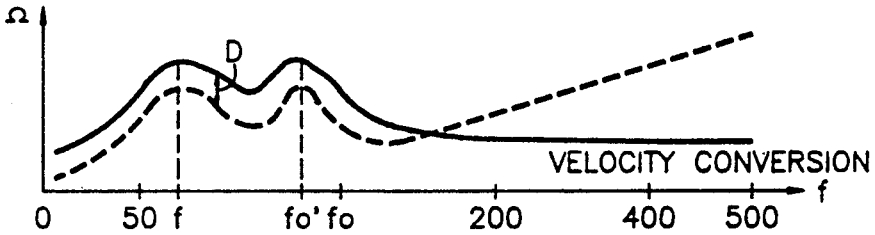
Figure 5D:
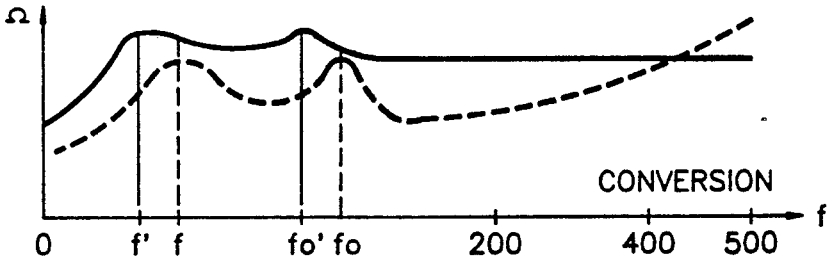
Figure 5E:
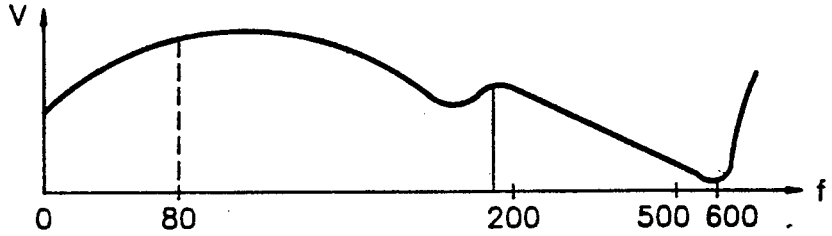

Turning now to the operation of the present invention with reference to FIGS. 4 and 5, the input audio signal voltage $E_i$ is amplified at an operational amplifier OP1 of the output amplifier 10 to $$\frac{R_3}{R_2}$$

and applied to the bridge circuit 20. A positive terminal of the woofer SP1 is connected with an output terminal of the operational amplifier OP1, and a negative terminal of the woofer SP1 is connected with a detecting resistor R5. Accordingly, the output voltage E of the operational amplifier OP1 is applied to the positive terminal of the woofer SP1, and a reference voltage is generated as a first signal $E_B$ by a variable resistor VR1 and the resistor $R_4$, and comparison voltage of the woofer SP1 including dynamic impedance is generated as a second signal $E_S$ by the woofer SP1 and the detecting resistor R5. The ratio of VR1:R4$=R_E$ (intrinsic input resistance of the woofer SP1):R5 is set to the above condition by adjusting the variable resistor VR1. Therefore, the first signal $E_B$ becomes a reference voltage obtained by dividing the output voltage of the operational amplifier OP1 by means of the variable resistor VR1 and the resistor $R_4$. The second signal $E_S$ becomes a comparison voltage including the dynamic impedance which is generated by motion of the vibration system of the woofer SP1. An operational amplifier OP2, with a non-inverse terminal and an inverse terminal connected to the first signal $E_B$ and the second signal $E_S$ respectively generates a difference voltage ($E_D=E_B-E_S$) of the two voltages. The difference voltage $E_B$ is proportionate to the motion of the vibration system of the woofer SP1, (i.e., a voltage proportionate to the dynamic impedance $Z_{EM}$). The voltage difference $E_D$ outputted from the operational amplifier OP2 is shown in FIG 5E. The voltage difference $E_D$ is amplified in terms of $$\frac{R_{11}}{R_{10}}$$

at an operational amplifier OP3 and then applied to the first low-pass filter 41 and the second low-pass filter 51.

Figure 5F:
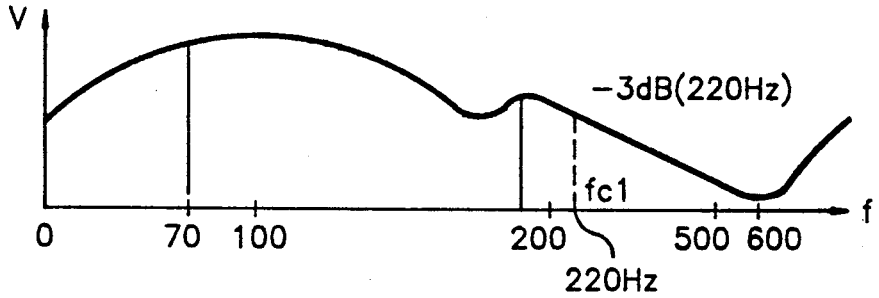
Figure 5G:
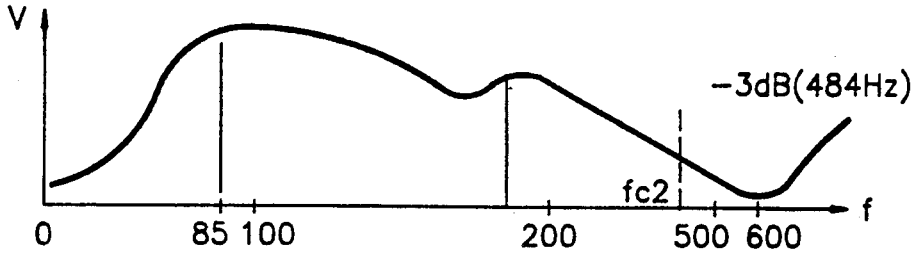

Next, the process of the acceleration conversion will be described. The low pass filter 41 receives the voltage difference $E_D$ proportionate to the motion of the vibration system of the woofer SP1 so as to filter a desired low frequency band of the input audio signal. The first low-pass filter 41 is a 3 dB filter of which cut-off frequency is set to 220 Hz. Accordingly, the voltage difference $E_D$ outputted from the first low-pass filter 41 shows the characteristics as illustrated in FIG. 5F, and herein the voltage difference $E_D$ gets voltage characteristic proportionate to the motion of the vibration system of the woofer SP1 at the desired low frequency band of below 220 Hz. The output of the first low pass filter 41 is applied to the differentiator 42 having the structure of a high pass filter with a cut-off frequency of 484 Hz.

Now, assuming that a reference character A represents a gain of the output amplifier 10, obtained by the operational amplifier OP1, and a reference character B represents a gain outputted from the first low-pass filter 41 and the differentiator 42, then the loop gain $A_{11}$ which is a value obtained by negatively feeding back the acceleration signal generated by the differentiator 42 is as shown in expression (11) and the overall gain $A_0$ is as shown in expression (12). Therefore, acceleration can be calculated by expression (13). As the acceleration signal is negatively fed back to be added to the input signal $E_B$ the lowest resonance frequency $f_o$ is shifted to $f_o'$ and the resonance sharpness $Q_o$ is converted to $Q_o'$ after the acceleration conversion by the difference signal $D_1$ that is a difference in the volume of acceleration feed-backs. As expressed in expressions (15) and (16), the lowest resonance frequency $f_o$ is decreased to $$\frac{1}{\sqrt{D}}$$

and the resonance sharpness $Q_o$ is increased by $\sqrt{D_1}$ times. That is, as illustrated in FIG. 5B, from the states of before and after acceleration conversion according to the characteristics of dynamic impedance, the lowest resonance frequency $f_o$ is lowered to the low frequency band by $$\frac{1}{\sqrt{D_1}}.$$

Figure 5H:
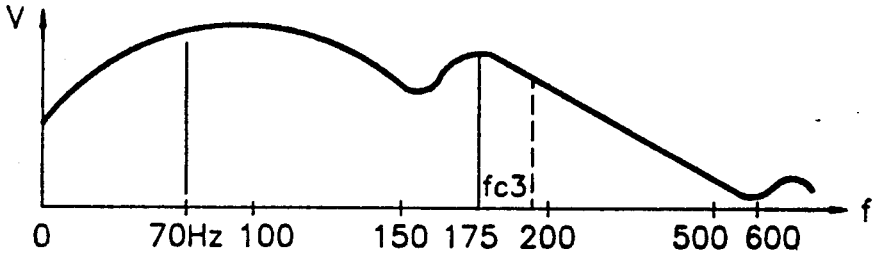

If the acceleration conversion is performed at this time, the characteristics of resonance sharpness $Q_o$ will be increased. Therefore the velocity conversion process is performed to decrease the resonance sharpness $Q_o$. In addition, the second low-pass filter 51, to which the voltage difference $E_D$ is applied, is set to have a cut-off voltage of 191 Hz as shown in FIG. 5H in order to compensate the resonance sharpness $Q_o'$, which is converted in the process of compensating the lowest resonance frequency $f_o$. That is, in the second low pass filter 51, capacitors C4 and C5, cut-off frequency fc3 and the resonance sharpness $Q_o$ can be expressed as shown in the expressions (23) to (26). Herein, R16=R17=R.

$$C4 = \frac{2Q}{2\pi fR} \tag{23}$$

$$C5 = \frac{1}{2Q2\pi fR} \tag{24}$$

$$fc3 = \frac{1}{2\pi R\sqrt{C_4 : C_5}} \tag{25}$$

$$Q_o = \frac{\sqrt{\frac{C_4}{C_5}}}{2} \tag{26}$$

When the cut-off frequency fc3 of the second low pass filter is set to 191 HZ, output of an operational amplifier OP6 is as shown in FIG. 5H, and in such case resonance sharpness $Q_o$ becomes $$\frac{1}{\sqrt{2}}.$$

In addition, the cut-off frequency fc4 of the high pass filter 52 receiving the first signal $E_B$ is set to 193 Hz, the cut-off frequency fc4 establishing a specific band for stabilizing the high frequency band of the signal input $E_i$. In the high pass filter 52, resistors R18 and R19, cut-off frequency fc4 and resonance sharpness $Q_o$ are expressed as shown the following expressions (27)–(30).

$$R18 = \frac{1}{2Q\omega_o C} \quad (27)$$

$$R19 = \frac{2Q}{\omega_o C} \quad (28)$$

$$fc4 = \frac{1}{2\pi C\sqrt{R_{18}R_{19}}} \quad (29)$$

$$Q_o = \frac{\sqrt{\frac{R_{19}}{R_{18}}}}{2} \quad (30)$$

Figure 5I:
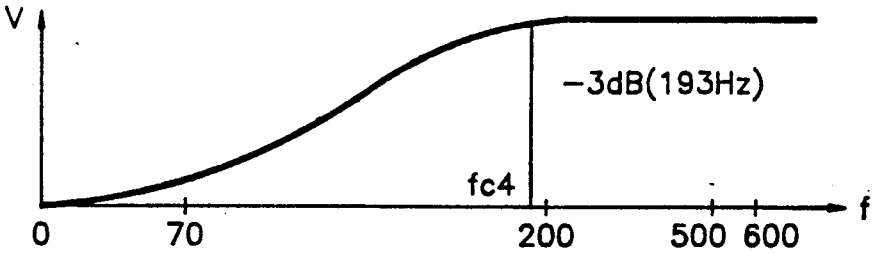

Therefore, if the cut-off frequency fc4 of the high pass filter 52 is 193 Hz, the output of the operational amplifier OP7 is as shown in FIG. 5I. At this moment, the resonance sharpness $Q_o$ becomes $$\frac{1}{\sqrt{2}}.$$

Figure 5J:
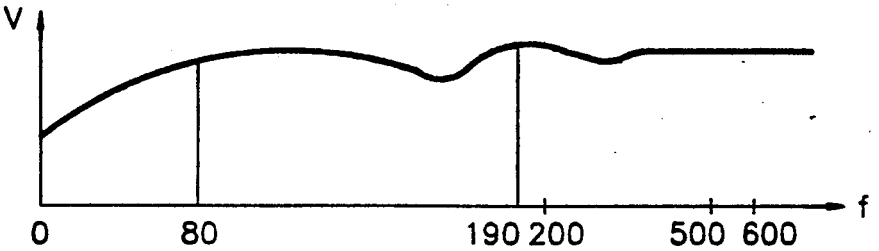

The output of the high-pass filter 52 is added at node 53 with the output of the second low pass filter 51 and outputted as shown in FIG. 5J. Referring to the voltage characteristics of the added signal as shown in FIG. 5J in view of impedance characteristics, the voltage characteristics are shown in FIG. 5C. In the drawing, it is noted that the lowest resonance frequency $f_o$ does not change but characteristics of the resonance sharpness $Q_o$ changes. That is, as expressed in expression (20), when voltage proportionate to the motion of the vibration system of the woofer SP1 is converted, the resonance sharpness $Q_o$ decreases to 1/D at the low frequency band, and the audio signal input is compensated not to be changed at the high frequency band by the feed-back operation. The added signal as shown in FIG. 5J is amplified at an operational amplifier OP8.

The velocity converted signal and the acceleration converted signal are mixed at a node 61 in order to compensate the characteristics of the lowest frequency $f_o$ and the resonance sharpness $Q_o$ of the low frequency band. The high frequency band signal is compensated not to be influenced during feed-back, and then the added signal is added with input audio signal Ei at a node 62. Of the signals added at node 61, the acceleration converted signal is negatively fed back to the input signal $E_i$, while the velocity converted signal is positively fed back. Thereby, the characteristics of final impedance generated at the node 61 turns out to be as shown in FIG. 5D. When the added signal is compared with original impedance characteristics of the speaker, the lowest resonance frequency $f_o$ and resonance sharpness $Q_o$ characteristics of the added signal are compensated at the low frequency band and stabilized at the high frequency band. Therefore, the sound reproduction efficiency at the low frequency band is increased and the sound reproduction efficiency at the high frequency band is stabilized.

As described in the foregoing, the present invention has an advantage that it can improve the medium and low frequency band sound characteristics and stabilize the high frequency band sound by detecting dynamic impedance by means of utilizing the motion of the vibration system, the motion being caused according to driving of the speaker, thereafter performing velocity and acceleration conversions for the detected dynamic impedance and feeding those converted signals back to the vibration system of the speaker. In this way, the low frequency band reproduction characteristics of the speaker can be improved and low frequency band sound can be faithfully reproduced in an audio system that has small-sized speakers.

What is claimed is:

1. A circuit for compensating low and minimum frequency band reproduction characteristics in a speaker system with at least one speaker for reproducing an audio signal supplied at an audio input terminal, said circuit comprising:

means for detecting dynamic impedance of a vibration system of the at least one speaker in response to a motion velocity component of the vibration system, caused by the audio signal;

acceleration conversion means for filtering a first low frequency band of the dynamic impedance and for converting the dynamic impedance to an acceleration component, to compensate a lowest resonance frequency of the at least one speaker to a low frequency proportionate to said dynamic impedance;

velocity conversion means for providing a velocity component of the dynamic impedance by filtering a high frequency band and a second low frequency band of said dynamic impedance to compensate a resonance sharpness of said at least one speaker; and first adding means for adding the acceleration component with the velocity component to negatively feed back the acceleration component to the audio signal terminal and to positively feed back the velocity component to the audio signal terminal;

whereby a low frequency band reproduction characteristic of said speaker is compensated by feeding back the dynamic impedance to said vibration system by way of the acceleration and velocity components.

2. The circuit as claimed in claim 1, wherein said means for detecting dynamic impedance comprises:

a bridge circuit for generating a first signal which is a reference signal by dividing the audio signal, and for generating a second signal with the dynamic impedance by dividing an output voltage of said speaker; and a differential amplifier for detecting a differential voltage signal between said first and second signals to detect a motion velocity component proportionate to the dynamic impedance.

3. The circuit as claimed in claim 2, wherein said acceleration conversion means comprises:

a first low pass filter for filtering the first low frequency band from the differential voltage signal; and a differentiator for differentiating the first low pass filtered signal to the acceleration component, thereby shifting the lowest resonance frequency of said speaker to the low frequency proportionate to said dynamic impedance.

4. The circuit as claimed in claim 3, wherein said velocity conversion means comprises:

a second low pass filter for filtering the second low frequency band from the differential voltage signal to compensate resonance sharpness at the second low frequency band;

a high pass filter for filtering the high frequency band from said first signal to stabilize high frequency characteristics of the audio signal; and second adding means for adding the second low pass filtered signal with the high pass filtered signal to compensate the resonance sharpness at the second low frequency band and stabilize the characteristics of the high frequency band of said speaker.

5. A method for compensating low frequency band reproduction characteristics of a speaker with a vibration system, said method comprising the steps of:

detecting dynamic impedance of the vibration system in response to a motion velocity component of said vibration system by bridge-balancing an audio signal;

performing an acceleration conversion to compensate a first low frequency band of lowest resonance frequency of said speaker, proportionate to the dynamic impedance by first low pass filtering the dynamic impedance of said motion velocity component to the first low frequency band and differentiating the first low pass filtered dynamic impedance to provide an acceleration signal;

performing velocity conversion to provide a velocity signal to decrease resonance sharpness of said speaker through compensation by second low pass filtering a second low frequency band of the dynamic impedance of said motion velocity component; and adding means for adding said acceleration signal with said velocity signal, and negatively feeding back the acceleration signal to said audio signal and positively feeding back the velocity signal to said audio signal.

6. A circuit for compensating low and minimum frequency band reproduction characteristics in a speaker system with at least one speaker for reproducing an audio signal supplied at an audio input terminal, said circuit comprising:

means for detecting dynamic impedance of a vibration system of the at least one speaker in response to a motion velocity component of the vibration system caused by the audio signal, said means for detecting dynamic impedance comprising a bridge circuit for generating a first signal which is a reference signal by dividing the audio signal, and for generating a second signal with the dynamic impedance by dividing an output voltage of said speaker, and a differential amplifier for detecting a differential voltage signal between said first and second signals to detect motion velocity component proportionate to the dynamic impedance;

acceleration conversion means for filtering a first low frequency band of the dynamic impedance, and for converting the dynamic impedance to an acceleration component, to compensate a lowest resonance frequency of the at least one speaker to a low frequency proportionate to said dynamic impedance, said acceleration conversion means comprising a first low pass filter for filtering the first low frequency band from the differential voltage signal, and a differentiator for differentiating the first low pass filtered signal to provide the acceleration component, thereby shifting the lowest resonance frequency of said speaker to the low frequency proportionate to said dynamic impedance;

velocity conversion means for providing a velocity component of the dynamic impedance by filtering a high frequency band and a second low frequency band of said dynamic impedance to compensate a resonance sharpness of said at least one speaker, said velocity conversion means comprising a second low pass filter for filtering the second low frequency band from the differential voltage signal to compensate resonate sharpness at the second low frequency band, a high pass filter for filtering the high frequency band from said first signal to stabilize high frequency characteristics of the audio signal, and second adding means for adding the second low pass filtered signal with the high pass filtered signal to compensate the resonance sharpness at the second low frequency band and to stabilize the characteristics of the high frequency band of said speaker; and first adding means for adding the acceleration component with the velocity component to negatively feedback the acceleration component to the audio signal terminal and to positively feedback the velocity component to the audio signal terminal, whereby a low frequency band reproduction characteristic of said speaker is compensated by feeding back the dynamic impedance to said vibration system by way of the acceleration and velocity components.

* * * * *

UNITED STATES PATENT AND TRADEMARK OFFICE

CERTIFICATE OF CORRECTION

PATENT NO. : 5,226,089

DATED : July 6, 1993

INVENTOR(S) : Sang-Lak Yoon, et al.

It is certified that error appears in the above-indentified patent and that said Letters Patent is hereby corrected as shown below:

On the title page: IN THE ATTORNEY'S NAME

Attorney's name was omitted after the Primary Examiner's name please insert, --*Attorney, Agent, or Firm*--Robert E. Bushnell--

Column 6,

Line 32, change "(15) and (15)" to --(15) and (16)--;

Column 7,

Line 34, delete "outputted";

Column 9,

Line 31, change "$E_B$" to --$E_D$--;

Column 10,

Line 2, change "$E_B$" to --$E_i$--; and

UNITED STATES PATENT AND TRADEMARK OFFICE

CERTIFICATE OF CORRECTION

PATENT NO. : 5,226,089

DATED : July 6, 1993

INVENTOR(S) : Sang-Lak Yoon, et al.

It is certified that error appears in the above-indentified patent and that said Letters Patent is hereby corrected as shown below:

Column 10, line 53, after "pass filter", insert --51--.

Signed and Sealed this

Thirtieth Day of August, 1994

Bruce Lehman

*Attest:*

BRUCE LEHMAN

*Attesting Officer*

*Commissioner of Patents and Trademarks*